US011085638B2

(12) United States Patent
Chirumbolo et al.

(10) Patent No.: US 11,085,638 B2
(45) Date of Patent: Aug. 10, 2021

(54) DEVICE FOR CONTROLLING THE IGNITION OF GAS BURNERS OF A DOMESTIC COOKING APPLIANCE

(71) Applicant: Illinois Tool Works Inc., Glenview, IL (US)

(72) Inventors: Dino Chirumbolo, Settimo Torinese (IT); Bruno Minniti, Milan (IT)

(73) Assignee: Illinois Tool Works Inc., Glenview, IL (US)

( * ) Notice: Subject to any disclaimer, the term of this patent is extended or adjusted under 35 U.S.C. 154(b) by 375 days.

(21) Appl. No.: 16/179,132

(22) Filed: Nov. 2, 2018

(65) Prior Publication Data

US 2019/0137100 A1 May 9, 2019

(30) Foreign Application Priority Data

Nov. 8, 2017 (IT) ..... 102017000127114

(51) Int. Cl.

| | |
|---|---|
| ***F23Q 3/00*** | (2006.01) |
| ***F24C 3/10*** | (2006.01) |
| ***F24C 3/12*** | (2006.01) |
| ***H01T 13/20*** | (2006.01) |
| *H01H 3/02* | (2006.01) |

(52) U.S. Cl.

CPC ..... *F23Q 3/006* (2013.01); *F23Q 3/00* (2013.01); *F24C 3/103* (2013.01); *F24C 3/126* (2013.01); *H01T 13/20* (2013.01); *H01H 3/0206* (2013.01)

(58) Field of Classification Search

CPC ... F23Q 3/006; F23Q 3/00; F23Q 7/02; F23Q 7/04; F23Q 7/16; F23Q 2/164; F23Q 3/002; F23Q 2/287; F23Q 2/32; F24C 3/103; F24C 3/126; F24C 1/04; F24C 3/02; F24C 3/08; F24C 3/006; F24C 3/12; F24C 1/02; F24C 3/128; F24C 15/023; F24C 15/12; F24C 3/022; F24C 3/04; F24C 3/082; F24C 3/122; F24C 3/124; F24C 7/065; H01H 3/0206; A47J 37/07; A47J 37/0713;

(Continued)

(56) References Cited

U.S. PATENT DOCUMENTS 3,768,959 A 10/1973 Rohde et al.

FOREIGN PATENT DOCUMENTS

| | | |
|---|---|---|
| WO | 2014058716 A1 | 4/2014 |
| WO | 2016039703 A1 | 3/2016 |

OTHER PUBLICATIONS

International Search Report and Written Opinion for Application PCT/US2018/059166 dated May 12, 2020.

*Primary Examiner* — Jason Lau

(74) *Attorney, Agent, or Firm* — Boyle Fredrickson, S.C.

(57) ABSTRACT

A device is provided for controlling the ignition of gas burners of a domestic cooking appliance. The device includes an electric switch with an insulating casing that carries a pair of fixed electric contacts. A movable body carries a movable electric contact that cooperates with the fixed electric contacts. The movable body is displaceable with respect to the casing between an open position and a closed position. An elastic element elastically pushes movable body toward the open position. A flexible cable has a first end that is anchored to the movable body and a second end that is anchored to a fixed support. A plurality of actuating members is associated with respective gas taps and have movable elements that cooperate with respective sections of the flexible cable. Each actuating member can bend a respective portion of the flexible cable into corrugated shape during the opening of the respective gas tap.

9 Claims, 9 Drawing Sheets

(58) Field of Classification Search
CPC .... A47J 37/0727; A47J 37/074; A47J 37/079; F16K 11/065; F16K 31/12; F16K 37/0041; F16K 37/0091; F16K 11/0836; F16K 37/0083; F16K 31/025; F16K 17/36; F16K 37/0075; F16K 17/38; F16K 17/383; F16K 1/36; F16K 1/446; F16K 1/487; F16K 31/007; F16K 31/04; F16K 31/0655; F16K 31/0658; F16K 31/082; F16K 31/1266; F16K 31/385; F16K 31/50; F16K 37/00; F16K 37/0033; F16K 49/005; F16K 51/02; F16K 5/0207; F16K 5/106; F23N 2235/18; F23N 2235/24; F23N 1/007; F23N 1/005; F23N 1/002; F23N 2237/02; F23N 2237/08; F23N 2235/16; F23N 2241/04; F23N 5/24; F23N 2231/28; F23N 5/105; F23N 2223/04; F23N 2225/04; F23N 2231/10; F23N 2231/18; F23N 2241/08; F23N 5/242; F23N 1/00; F23N 2005/185; F23N 2223/08; F23N 2225/16; F23N 2227/26; F23N 2229/02; F23N 2235/02; F23N 2235/08; F23N 2235/20; F23N 2237/10; F23N 2237/20; F23N 2239/04; F23N 2241/06; F23N 3/042; F23N 5/003; F23N 5/042; F23N 5/102; F23N 5/107; F23N 5/14; F23N 5/184; F23N 5/203; F23N 5/245; F23C 1/08; F23C 13/00
See application file for complete search history.

DEVICE FOR CONTROLLING THE IGNITION OF GAS BURNERS OF A DOMESTIC COOKING APPLIANCE

FIELD OF THE INVENTION

The present invention relates to a control device for a gas burner ignition system.

The invention has been developed in particular for use in domestic cooking appliances provided with a plurality of gas burners controlled by respective gas taps.

BACKGROUND OF THE INVENTION

Domestic cooking appliances for kitchens, generally known as "cooktops", comprise a plurality of gas burners associated with respective gas taps which allow the user to adjust the flame intensity. Generally, gas burners are associated with respective spark plugs to ignite the flow of combustible gas. The spark plugs are electrically connected to an electric igniter which supplies spark plugs with a high voltage current designed to generate the spark discharge on the spark plugs. The electric igniter is in turn controlled by a plurality of switches, each of which is associated with a respective gas tap. The switches are closed when the respective gas tap is opened. The closing of any of the switches associated with the gas taps closes the igniter power supply circuit and produces the spark discharge on the spark plugs.

A switch device for domestic cooking appliances is described, for example, in WO2014/189621.

One of the drawbacks of the solutions according to the prior art is that a plurality of electric switches are required to produce the spark discharge. Furthermore, the positioning of each electric switch at the corresponding tap compromises the liquid seal.

In addition, the cooking appliances of a known type generally require switches of a different type depending on whether the spark plug ignition control occurs with a rotary movement or with an axial movement of the knob.

OBJECT AND SUMMARY OF THE INVENTION

The object of the present invention is to provide a control device which overcomes the drawbacks of the prior art.

According to the present invention, this object is achieved by a control device having the features forming the subject of claim 1.

According to another aspect, the invention relates to a domestic cooking appliance having the features forming the subject of claim 8.

The claims form an integral part of the teaching given in connection with the invention.

BRIEF DESCRIPTION OF THE DRAWINGS

The present invention will now be described in detail with reference to the accompanying drawings, given purely by way of non-limiting example, in which.

It will be appreciated that for simplicity and clarity of description, the figures may not be reproduced on the same scale.

DETAILED DESCRIPTION

Figure 1:
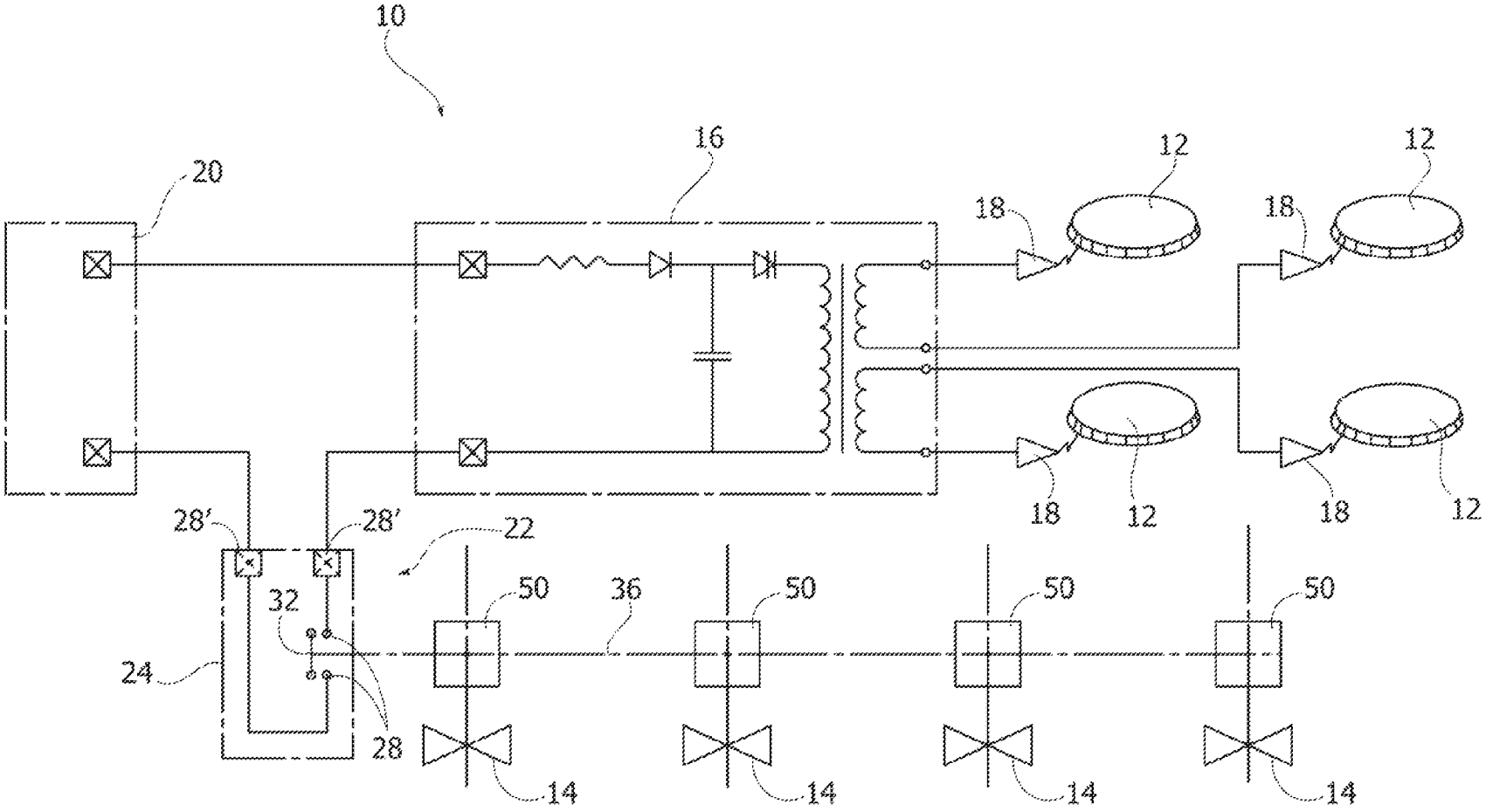
FIG. 1 is a schematic view illustrating a domestic cooking appliance provided with a control device according to the present invention.

In FIG. 1, reference numeral 10 indicates as a whole a domestic cooking appliance. The domestic cooking appliance comprises a plurality of gas burners 12 connected to respective gas taps 14 which regulate the flow rate of the gas flow supplied to the respective gas burners 12. The gas taps 14 can be aligned with each other along a straight line, as is customary for domestic cooktops.

The cooking appliance 10 comprises an electric igniter 16 and a plurality of spark plugs 18 adjacent to respective gas burners 12 and electrically connected to the electric igniter 16. The electric igniter 16 is electrically connected to a terminal board 20 connected to the power supply network.

The cooking device 10 comprises a control device 22 which controls the electric discharge of the spark plugs 18 when one of the gas taps 14 is opened. The control device 22 comprises a single electric switch 24 that can be switched between an open position and a closed position, which opens and closes the power supply circuit of the electric igniter 16.

With reference to FIGS. 2-6, the electric switch 24 comprises a casing 26 in which two fixed electric contacts 28 are housed, having respective terminals 28'. The switch 24 comprises a movable body 30 carrying a movable electric contact 32. The movable body 30 is displaceable within the casing 26 between an open position (FIG. 5) and a closed position (FIG. 6) in the direction indicated by arrow A. In the open position, the movable contact 32 is not in contact with the fixed contacts 28 so that the fixed contacts 28 are electrically insulated from each other. In the closed position, the movable contact 32 is in contact with the fixed contacts 28 and establishes an electric contact between the fixed contacts 28. The fixed contacts 28 have the shape of plates parallel to each other and parallel to the direction of movement A of the movable body 30. The movable contact 32 has two elastically deformable wings which bend towards the center when the movable contact 32 is inserted between the fixed contacts 28.

The electric switch 24 comprises an elastic element 34, for example consisting of a helical compression spring, which pushes the movable body 30 towards the open position.

Again with reference to FIGS. 2-6, the control device 22 comprises a flexible cable 36 stretched along a rectilinear direction parallel to the direction along which the gas taps 14 are aligned with each other. The flexible cable 36 is made of an electrically insulating material and may, for example, be made of Kevlar or materials with similar features. The flexible cable 36 has a first end 38 anchored to the movable body 30 of the switch 24. For example, the first end 38 may be fixed to a first stop 40 which rests on a front surface of the movable body 30.

Figure 2:
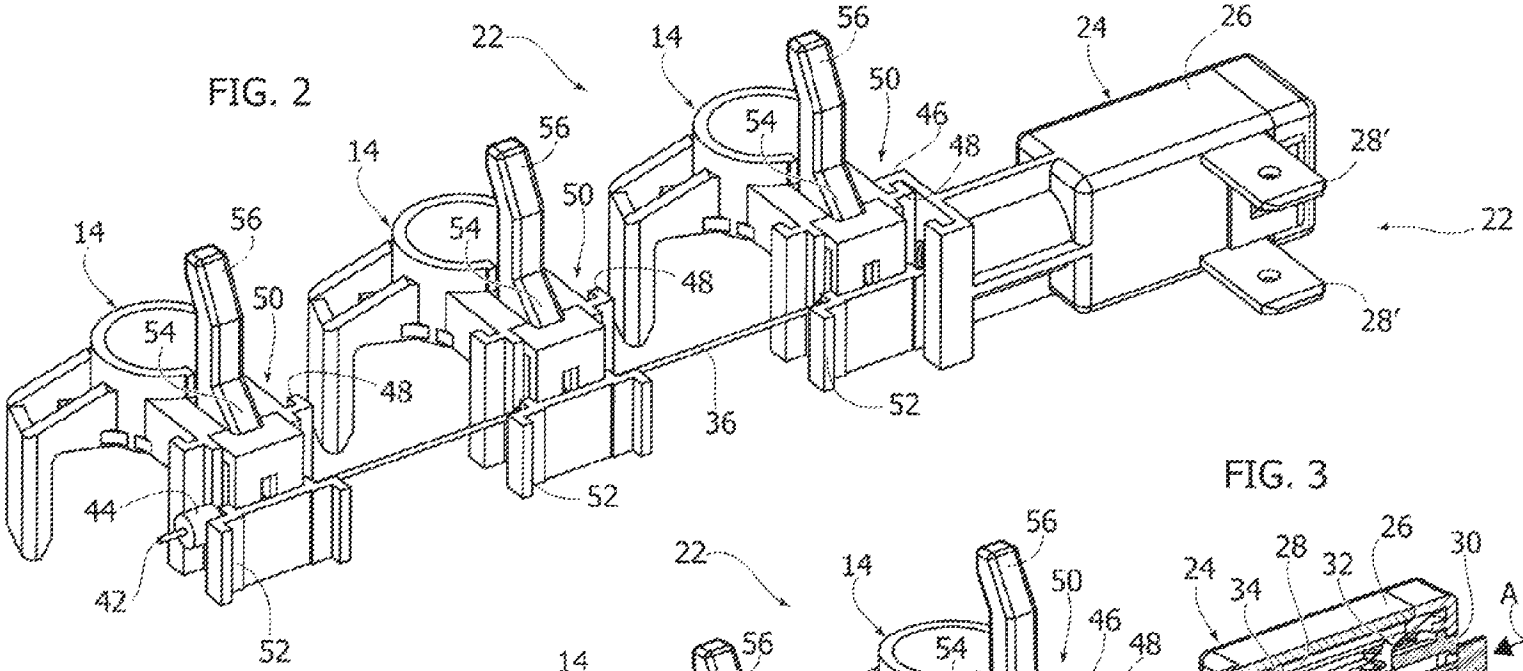
FIG. 2 is a perspective view of a control device according to the present invention.
Figure 3:
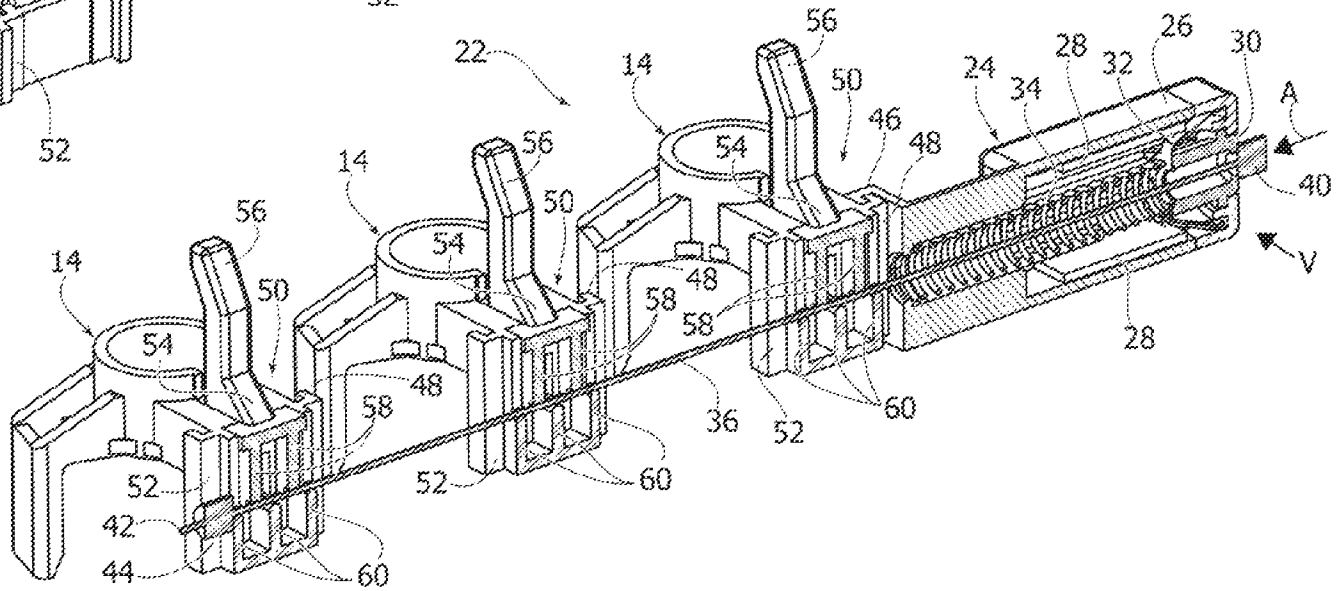
FIG. 3 is a partially sectional perspective view showing the control device in FIG. 2 in an open position.
Figure 4:
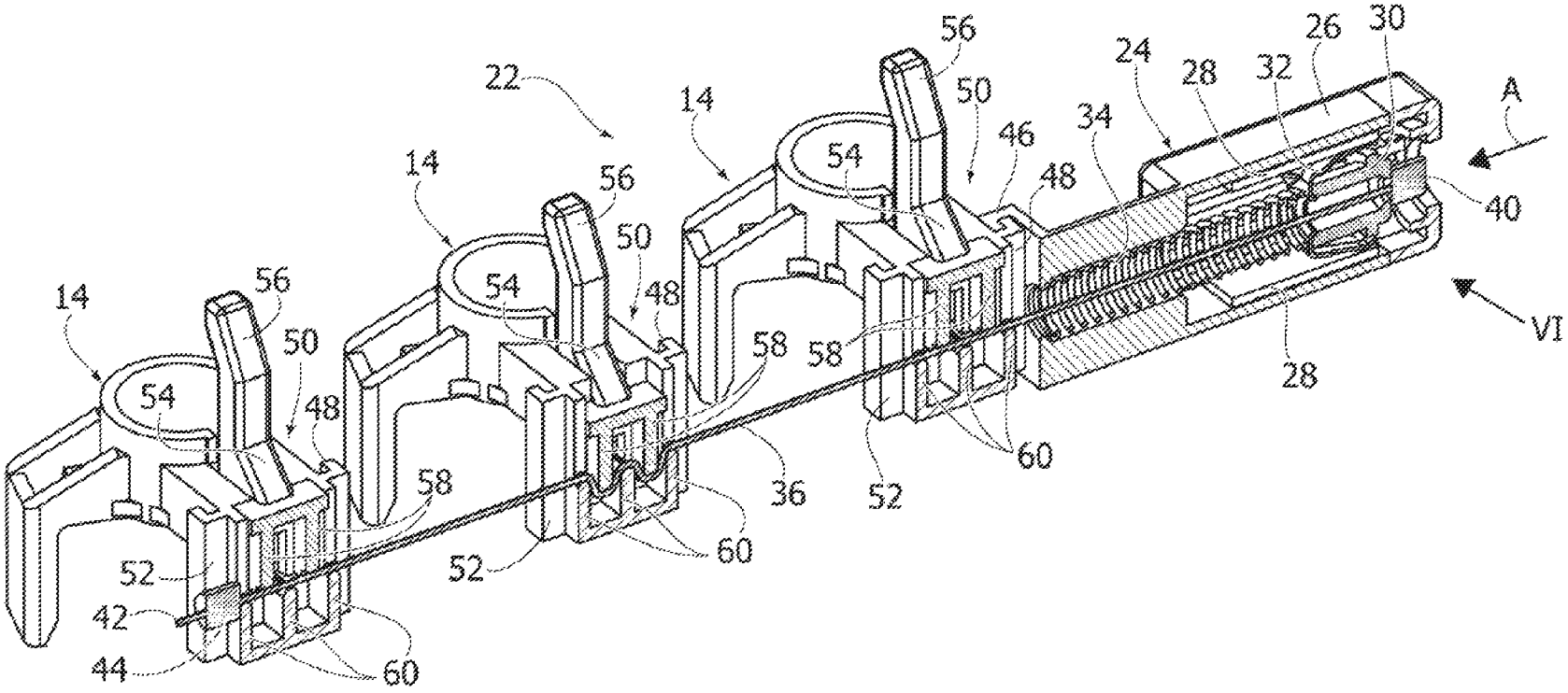
FIG. 4 is a partially sectional perspective view showing the control device in FIG. 2 in a closed position.
Figure 5:
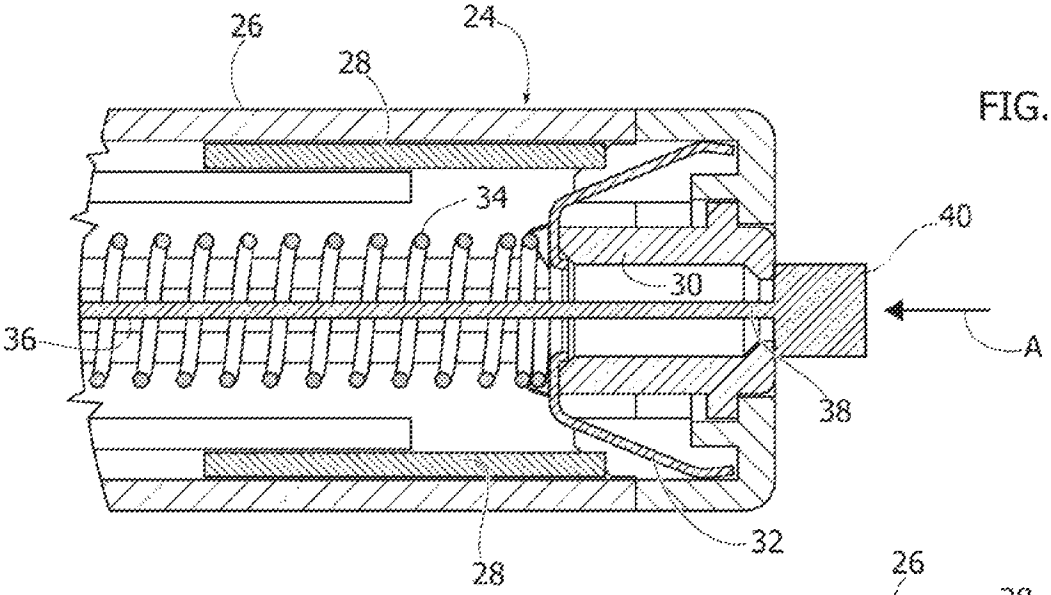
FIGS. 5 and 6 are partial sections in greater scale of the parts indicated by arrows V and VI, respectively, in FIGS. 3 and 4.

With reference to FIGS. 2-4, the control device 22 comprises a plurality of actuating members 50 associated with respective gas taps. Each actuating member 50 cooperates with a respective section of the flexible cable 36 and is adapted to bend the respective section of the flexible cable 36 during opening of the respective gas tap 14.

With reference to FIGS. 2-4, each actuating member 50 comprises a support 52 fixed to the respective gas tap 14 and a movable element 54 movable with respect to the support 52 and cooperating with a respective section of the flexible cable 36. The movable element 54 of each actuating member 50 is movable along a rectilinear transverse direction with respect to the flexible cable 36.

The actuating member 50 slides freely along the flexible cable 36 when not directly connected to the switch 24.

The switch 24 may be fixed to an actuating member 50, for example by means of a portion 46 of the casing 24 engaging a dovetail part 48 of a support 52 attached to one of the gas taps 14. The flexible cable 36 extends outside the casing 26 of the switch 24 by a length substantially equal to the distance between the gas taps 14 furthest from each other. The flexible cable 36 is kept taut in a straight condition by the elastic force of the elastic element 34.

The flexible cable 36 has a second end 42 which is anchored to a fixed support. The second end 42 of the flexible cable 36 may be anchored by means of a stop 44 to the support 52 mounted on the gas tap 14 farther than the switch 24.

Figure 14:
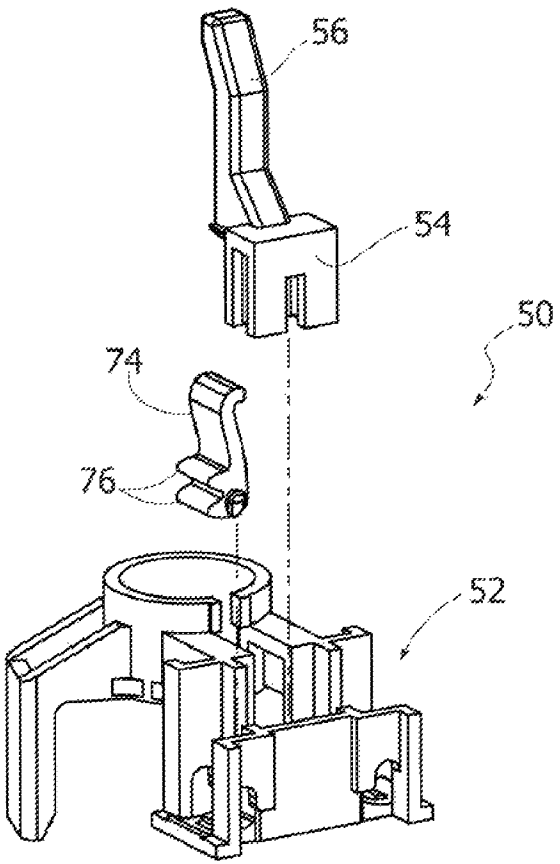
FIG. 14 is an exploded perspective view of the control member in FIG. 12.
Figure 13:
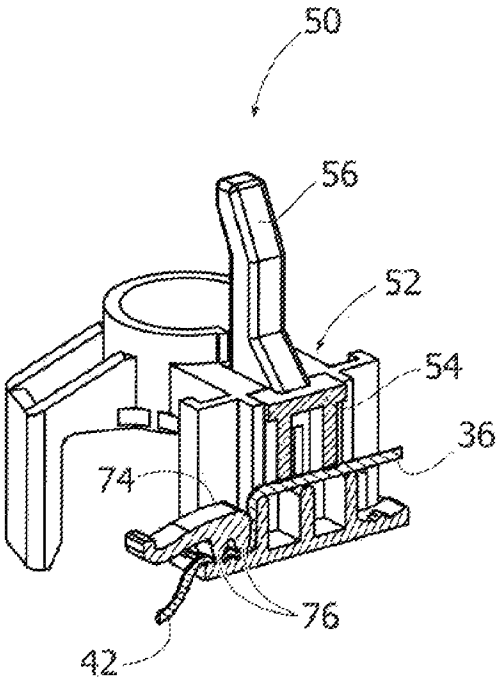
FIG. 13 is a partially sectional perspective view of the control member in FIG. 12.
Figure 12:
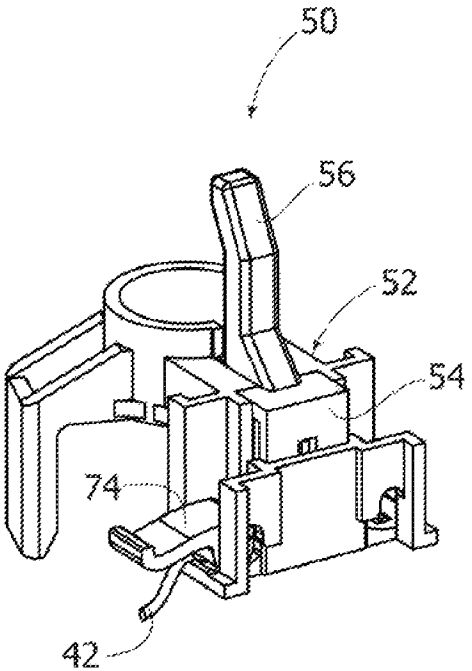
FIG. 12 is a perspective view of an alternative embodiment of an actuator member provided with a lever element for anchoring one end of a flexible cable.

In the embodiment shown in FIGS. 12, 13 and 14, the support 52 mounted on the gas tap farthest from the switch 24 carries a lever 74 articulated to the support 52. The lever 74 is provided with teeth 76 adapted to lock the second end 42 of the cable 36 against a wall of the support 52.

Figure 6:
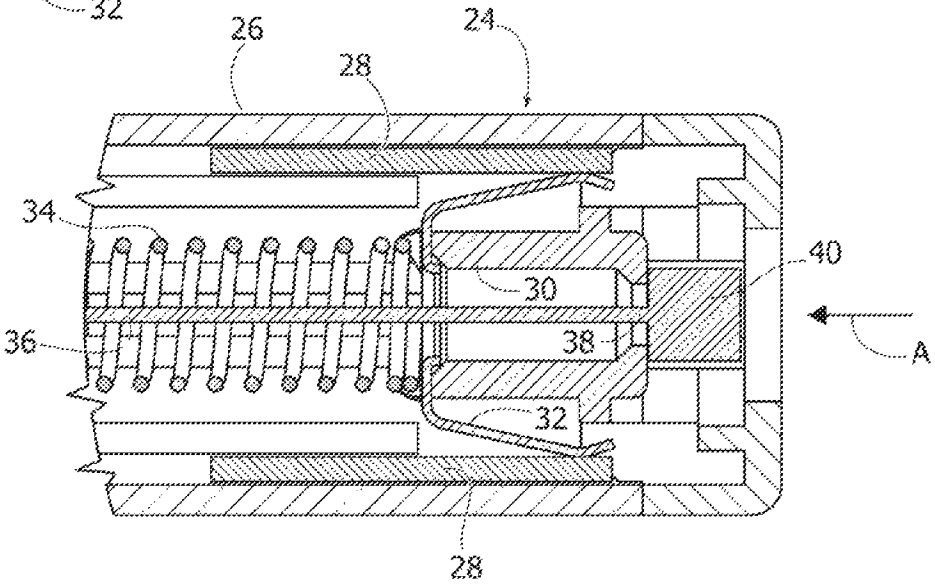

The flexible cable 36 has the function of controlling the movement of the movable body 30 between the open position (FIG. 5) and the closed position (FIG. 6). When one or more sections of the flexible cable 36 are bent in a direction orthogonal to the longitudinal axis of the flexible cable 36, the end 38 of the flexible cable 36 moves in the direction indicated by arrow A and moves the movable body 30 towards the closed position. During this movement, the movable body 30 compresses the elastic element 34. When the deformation of the flexible cable 36 ceases, the elastic element 34 returns the movable body 30 to the open position and the flexible cable 36 returns to the straight configuration. The flexible cable 36 is not an electric cable and has only a mechanical function.

In the embodiment shown in FIGS. 2-4 and 7, 8, the movable element 54 of each actuating member 50 is movable in a direction parallel to the axis of the stem of the respective gas tap 14. The movable element 54 of each actuating member 50 has a projecting portion 56 which, for example, rests on the lower side of a knob of the respective gas tap 14 or on the lower side of a bush pre-assembled on the stem of the gas tap 14 (Patent ITW U.S. Pat. No. 7,243,647B2). To open the gas tap, the user presses the knob downwards and then rotates it to the position corresponding to the desired flame intensity. During the downward pressure of the knob, the respective movable element 54 is pushed downwards, which bends the corresponding section of the flexible cable 36 and controls the closing of the switch 24. When the knob is released, the downward pressure on the movable element 54 ceases and the elastic element 34 returns the flexible cable 36 to the undeformed straight configuration. The support 52 and the movable element 54 of each actuating member 50 may be provided with respective teeth 60, 58 which interpenetrate with each other so as to bend the respective section of the flexible cable 36 according to a corrugated shape (FIG. 4).

Figure 8:
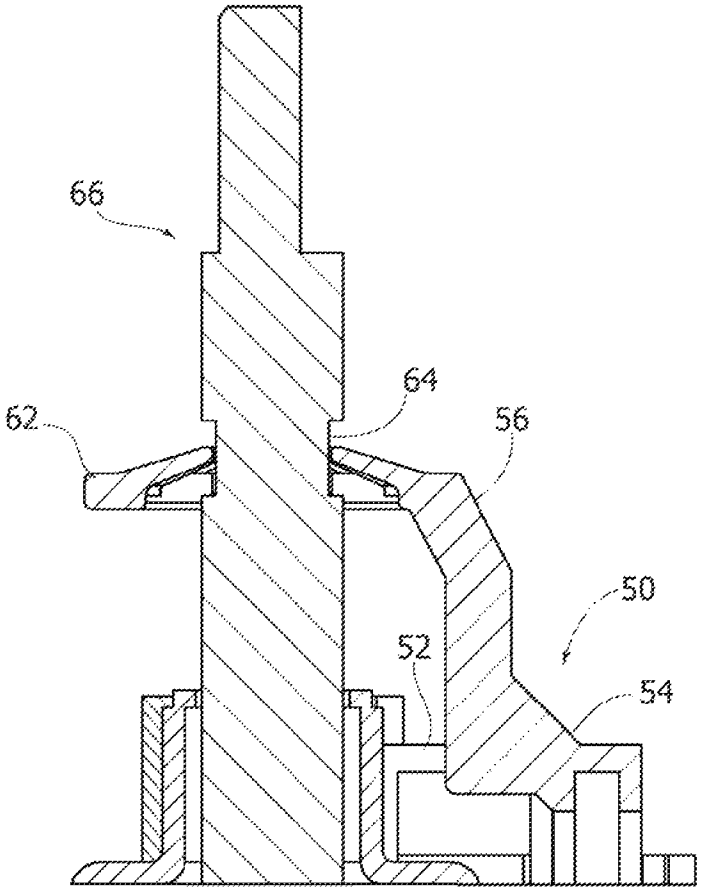
FIG. 8 is a section according to a plane passing through line VIII-VIII in FIG. 7.
Figure 7:
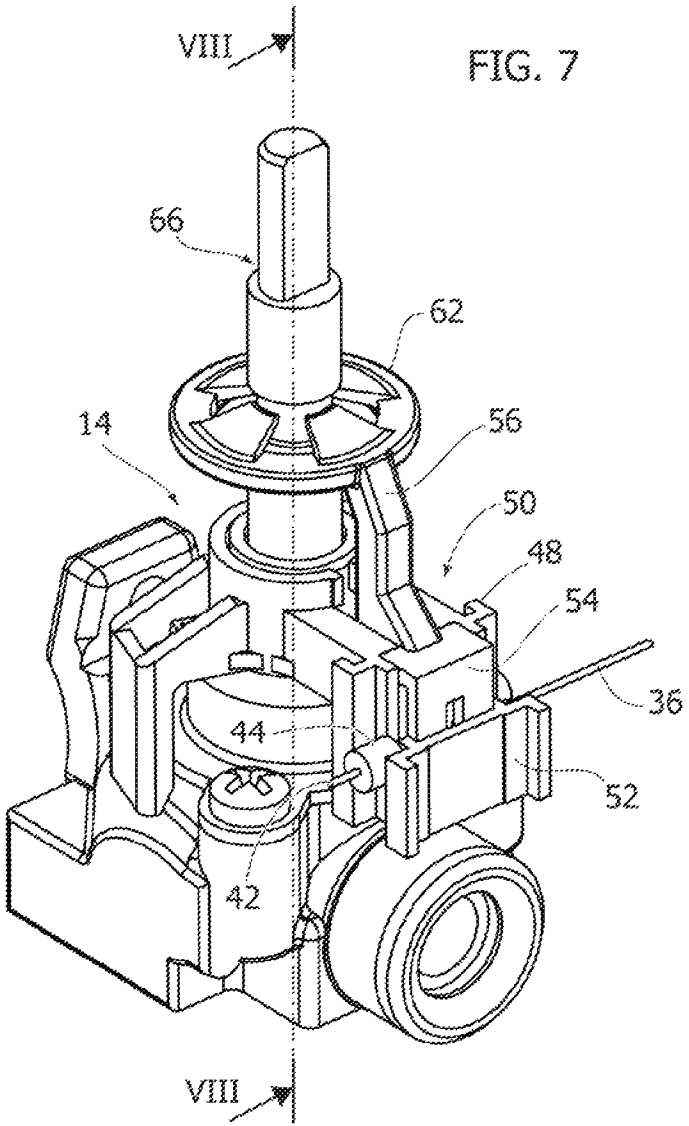
FIG. 7 is a perspective view of a gas tap provided with an actuator according to a first embodiment.
Figure 9:
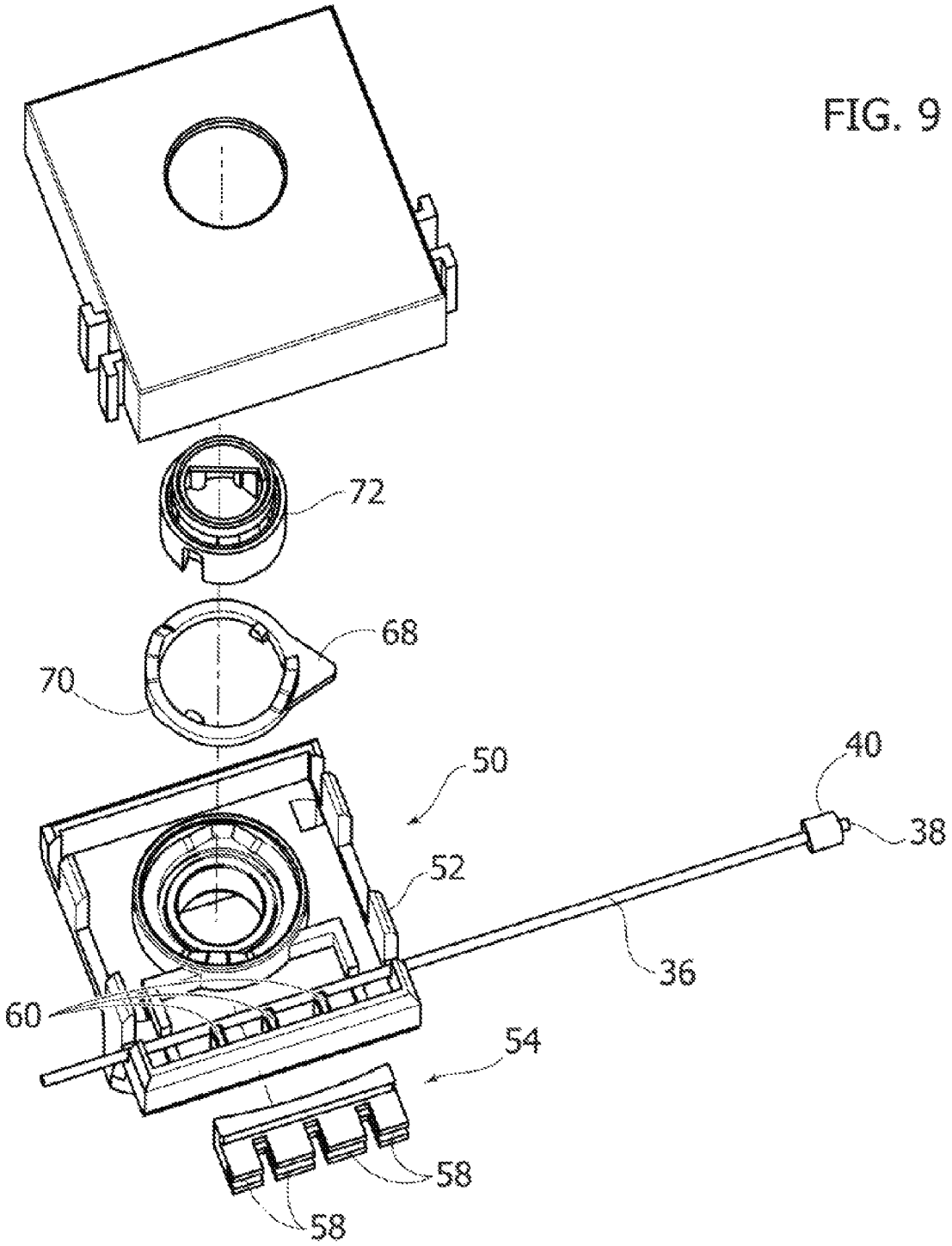
FIG. 9 is an exploded perspective view of a second embodiment of an actuator member.

In the variant shown in FIGS. 7 and 8, the movable element 54 of each actuating member 50 may comprise a ring 62 integral with the projecting portion 56 and engages with clearance on the axial direction with a groove 64 formed on the stem 66 of the respective gas tap 14. In this case, the projecting portion 56 does not cooperate with the knob or with a bush pre-assembled on the stem 66 but directly with the stem 66 of the gas tap 14.

Figures 10, 11:
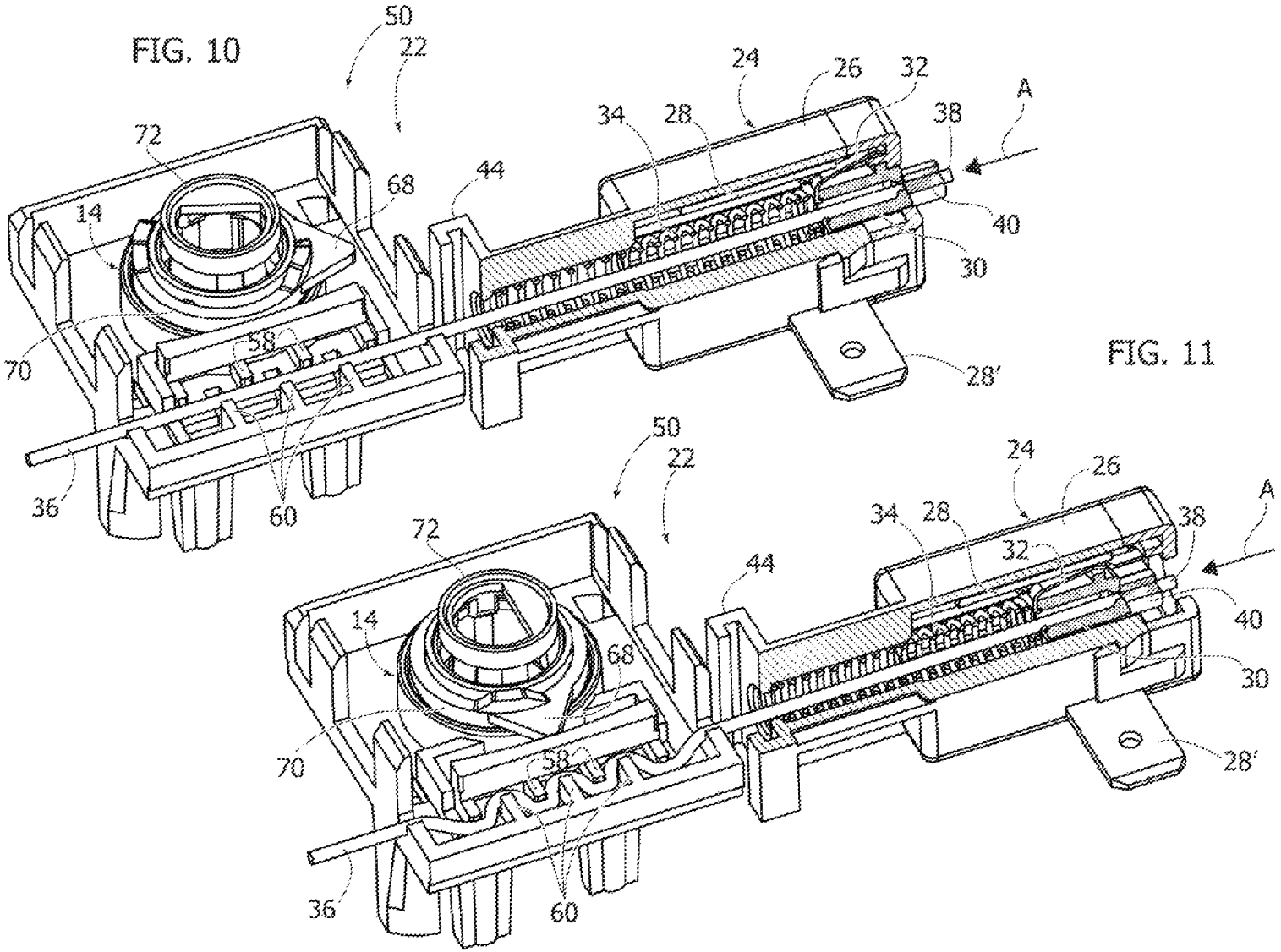
FIGS. 10 and 11 are partially sectional perspective views of a switch assembly according to the present invention provided with an actuator according to FIG. 9, in the open position and in the closed position, respectively.

FIGS. 10 and 11 illustrate an embodiment of the actuating member 50 in which the movable element 54 is movable along a rectilinear direction orthogonal to the axis of the stem of the gas tap 14. In this case, the movement of the movable element 54 is controlled by a projection 68 of a ring 70. The ring 70 cooperates with a rotating element 72 mounted on the stem of the respective gas tap 14. Also in this case, the movable element 54 and the support 52 of the actuating member 50 may be provided with teeth 58, 60 which interpenetrate with each other to bend the respective section of the flexible cable 36 according to a corrugated shape (FIG. 11). In this embodiment, the rotating body 72 and the ring 70 may be made as described in the document WO2014/189621, to prevent the generation of "return sparks" during the rotation of the gas tap knob in the closing direction.

Figure 15:
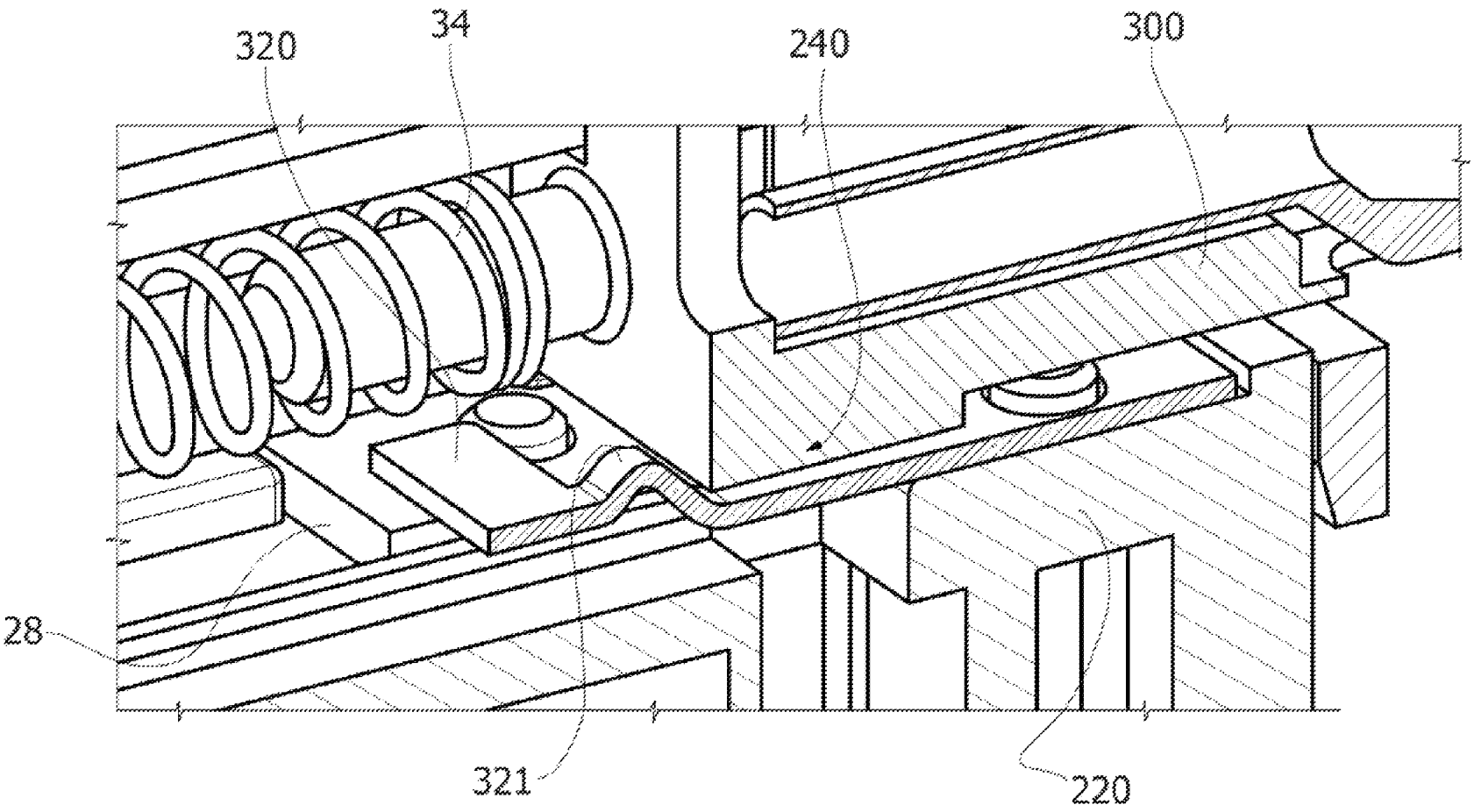
FIG. 15 is a schematic, partially sectional perspective view of a different embodiment of the control device according to the invention.

Referring now to FIG. 15, a possible variant 220 of the embodiment of the invention described above is schematically illustrated.

The control device 220 differs from the control device 22 already described only in a different embodiment of the switch 24, indicated with reference numeral 240.

The switch 240 is formed by a movable body 300, similar to the movable body 30; the movable body 300 is slidably housed against the action of the spring 34 within the casing 26. In this case, however, the movable contact 32 fixed on the movable body 30 is replaced by a movable contact 320 integrally carried by the casing 26, within the same and in a position below the movable body 300, which is free of contacts. The movable contact 320 is elastically deformable (it is a flexible foil contact) and is arranged facing, but normally away from, a fixed contact 28, also integral carried by the casing 26 within the same, so that the movable contact 320 is interposed between the movable body 300 and the fixed contact 28.

The movable contact 320 is also provided with a projection or tooth 321 towards the movable body 300, in the illustrated example implemented by means of a V-shaped bend of the foil constituting the movable contact 320; when the movable body 300 moves, it intercepts the pin or projection or tooth 321, thus causing the deflection (and therefore the displacement towards the closed position of the switch 240) of the movable contact 320.

The control device according to the present invention offers the following advantages:

- allows the use of a single electric switch to control the ignition of a cooking appliance,
- a flexible cable of insulating material (of Kevlar or of a material with similar features) is provided which replaces the electric wires between the various actuating elements,
- due to the possibility to bend the flexible cable in a corrugated shape, a short stroke of the gas tap knob can activate the electric switch offering compensation to the assembly tolerances,
- two gas taps can be activated simultaneously due to the long stroke of the contacts of the electric switch,
- the actuating members located on the gas taps are free of electric contacts,
- there are no more electric cables in the proximity of the gas taps,
- the electric switch is moved with respect to the position of the hob hole and is repaired from the accidental fall of liquids,
- two relatively short electric cables are sufficient to connect the electric switch to the igniter and to the terminal board,
- the movable elements of the actuating members may be mounted horizontally or vertically depending on the type of gas tap (linear or rotary control),
- the electric switch may be assembled on the first actuating member or it may be fixed directly to the hob,
- the electric switch is optimized to make it universal between the linear and rotary version of the device,
- the geometry of the support of the linear and rotary actuating members is standardized to allow the assembly of the electric switch on both sides,
- the geometry of the support of the linear and rotary actuating members is standardized to allow the assembly of the mechanical stop of the wire on both sides,
- the actuating members are free to slide along the wire before the installation of the device on the respective gas taps, so as to standardize the product by releasing it from the distances of the gas taps,
- due to the reduction in the number of components, in particular of the electric switches, the production process is simplified.

Of course, without prejudice to the principle of the invention, the details of construction and the embodiments may be widely varied without thereby departing from the scope of the invention as defined by the appended claims.

The invention claimed is:

1. A control device for controlling the ignition of gas burners of a domestic cooking appliance, comprising:

an electrical switch comprising an insulating casing carrying at least one fixed electric contact, a movable body which is displaceable with respect to the casing between an open switch position and a closed switch position, a movable electrical contact cooperating with the at least one fixed electric contact due to the displacement of the movable body, and an elastic element which elastically pushes the movable body towards the open switch position, a flexible cable stretched along a rectilinear direction, the flexible cable having a first end anchored to the movable body and a second end anchored to a fixed support, and a plurality of actuating members associated with respective gas taps and having respective movable elements which cooperate with respective sections of the flexible cable and bend respective portions of the flexible cable during the opening of the respective gas tap.

2. The control device of claim 1, wherein the electric switch includes an insulating casing carrying a pair of fixed electric contacts, a movable body carrying a movable electric contact cooperating with the fixed electric contacts, wherein the movable body is displaceable with respect to the casing between an open position and a closed position, and an elastic element which elastically pushes the movable body towards the open position.

3. The control device of claim 2, wherein the movable contacts are elongated in the direction of movement of the movable body and the movable contact has two deformable wings which bend in contact with the fixed contacts.

4. The control device of claim 1, wherein each of the actuating members comprises a support fixed to the respective gas tap and a movable element movable with respect to the support along a rectilinear direction transverse to the flexible cable.

5. The control device of claim 3, wherein the rectilinear direction along which the movable elements of the actuating members are movable is parallel or radial with respect to an axis of a stem of the respective gas tap.

6. The control device of claim 4, wherein the support and the movable element have respective teeth between which the respective section of the flexible cable extends, wherein the teeth interpenetrate each other to bend the respective section of the flexible cable according to a corrugated shape.

7. The control device according to claim 3, wherein the movable element of each actuating member comprises a ring which engages with clearance in an axial direction a groove formed on a stem of the respective gas tap.

8. The control device of claim 4, wherein the support mounted on the gas tap farthest from the switch carries a lever articulated to the support and provided with teeth adapted to lock one end of the cable against a wall of the support.

9. A domestic cooking appliance comprising:

a plurality of gas burners, a plurality of spark plugs associated with respective ones of the plurality of gas burners, an igniter electrically connected to the spark plugs, a plurality of gas taps for regulating the flow of gas supplied to respective ones of the plurality of gas burners, and a control device comprising:

an electrical switch comprising an insulating casing carrying at least one fixed electrical contact, a movable body which is displaceable with respect to the casing between an open switch position and a closed switch position, a movable electrical contact cooperating with the at least one fixed electrical contact due to the displacement of the movable body, and an elastic element which elastically pushes the movable body towards the open switch position, a flexible cable stretched along a rectilinear direction, the flexible cable having a first end anchored to the movable body and a second direction end anchored to a fixed support, and a plurality of actuating members associated with respective gas taps and having respective movable elements which cooperate with respective sections of the flexible cable and bend respective portions of the flexible cable during the opening of the respective gas tap, and wherein the control device is arranged to close the electric supply circuit of the igniter during the opening of each of the gas taps.

* * * * *